US006776299B1

(12) United States Patent
Trescott

(10) Patent No.: US 6,776,299 B1
(45) Date of Patent: Aug. 17, 2004

(54) AUTOMATIC INTERMODAL RAILWAY CAR COUPLER

(76) Inventor: William Bernard Trescott, 8028 Hwy. 457, Bay City, TX (US) 77414

( * ) Notice: Subject to any disclaimer, the term of this patent is extended or adjusted under 35 U.S.C. 154(b) by 0 days.

(21) Appl. No.: 10/696,366

(22) Filed: Oct. 30, 2003

(51) Int. Cl.[7] ..... B61G 5/06
(52) U.S. Cl. ..... 213/1.3; 213/75 R
(58) Field of Search ..... 213/1.3, 75 R, 213/75 TC, 76, 7, 159, 211, 212, 100, 136, 140, 216, 219; 280/515, 504

(56) References Cited

U.S. PATENT DOCUMENTS 4,426,012 A * 1/1984 Adams et al. ..... 213/135
5,060,965 A * 10/1991 Haefner et al. ..... 280/504
5,139,161 A * 8/1992 Long ..... 213/124
5,826,736 A * 10/1998 Weber ..... 213/75 A

* cited by examiner

*Primary Examiner*—Frantz F. Jules

(57) ABSTRACT

A railcar coupler which integrates fluid and electrical connections into one modular unit with increased facility for automatically connecting these connections when cars are pushed together and automatically disconnecting these connections when railway cars are lifted up off of railroad tracks.

21 Claims, 1 Drawing Sheet

A
B
C
D
10
11
12
13
14
15
16
17
18
19
20
21
22
23
24
25
26
27
28
29
30
31
32
33
34
35
36
37
38
39
40
41
42
43
44
45
46
47
48
49
50
51

AUTOMATIC INTERMODAL RAILWAY CAR COUPLER

FIELD OF THE INVENTION

This invention relates to railway vehicles, more specifically to couplers for joining a plurality of railway cars and locomotives together to form long trains.

BACKGROUND OF THE INVENTION

Couplers for connecting railway cars and locomotives together into trains are well known to those knowledgeable in the mechanical arts. The earliest couplers were simple iron chains hung between hooks attached to the ends of railway cars. Cars and locomotives using this very simple system required separate coil spring bumpers projecting from their corners to absorb the shock of impacting each other to prevent damage whenever the train stopped or slowed down Modern Janney-type couplers, such as shown in U.S. Pat. No. 6,148,733 to Gagliardino, a variation on the Type E coupler standard on American railways since 1932, perform both the connecting and shock absorbing functions. These have a pivotal vertical knuckle adapted to engage an identical vertical knuckle on an adjacent coupler so that when the couplers are brought into contact with each other, the two knuckles are pivoted into an interlocking engaging position. The use of oil and gas filled shock absorbers to cushion the impact when cars contact each other is also well known to those knowledgeable in the art, as shown in U.S. Pat. No. 5,415,303 to Hodges.

Gagliardino teaches that to permit a railway train to safely negotiate curves in the tracks, the couplers are pivotally connected to the railway car so that, pursuant to an American Association of Railways specification, each coupler can pivot 13 degrees in a horizontal plane to either side of the longitudinal center line of the car. Therefore, to join a pair of railway cars together, it may be necessary to pivot the couplers so that they are generally aligned and directly opposed to each other. While proper straight alignment may naturally result when a pair of cars are uncoupled while on a length of straight track, there are times when they are not properly aligned for joining. For example, when a pair of cars are uncoupled while on a curved track, the couplers will not normally extend perpendicularly from the end of the railway car, making proper coupling impossible when they are later moved onto a straight track. Similarly, there are times when railway cars to be coupled together are on a length of curved track, and the coupler shanks are oriented perpendicularly from the ends of the car to be joined rather than pivoting toward each other 13 degrees for proper joining. Accordingly, it may be necessary for a conductor or trainman to manually position the couplers by pushing or pulling them into proper alignment before the can can successfully be joined by moving the couplers into alignment by hand. If attempts to join a pair of railway cars are made when the couplers are not properly aligned, the impact of misaligned couplers may cause damage to one or both couplers.

In U.S. Pat. No. 6,575,101, Blute teaches that highway truck trailers can be coupled together to form trains using a horizontally oriented V shaped member, such as found on 5th wheel turntables of highway truck tractors. These usually include a U shaped jaw that pivots around a vertically oriented pin, such as the kingpin found on highway truck semi-trailers. The V shaped member does not need to be in perfect alignment with the pin for successful coupling.

Statement of the Problem

Advancements in transport refrigeration, hazardous material cargo monitoring, railway vehicle braking and control systems, and even national security requirements to prevent terrorism, have created a need for additional connections between railway cars such as compressed air hoses to power brakes and electrical cables to power refrigeration units, monitor access doors, or transmit data from temperature sensors. Electrically controlled anti-lock brakes, for instance, will allow railway trains to stop in a shorter distance without wearing flat spots on their steel wheels. Temperature sensors connected to the wheels will be able to detect hot wheel bearings and other potentially catastrophic maintenance problems before they occur, even on unmanned remote control trains because no provision for these additional fluid and electrical connections is included in existing railway car couplers, considerable manual labor is involved in attaching these additional wires and hoses and again in disconnecting them when cam are to be separated from a train. It is desired to provide a coupler that incorporates additional fluid and electrical connections and can also be operated remotely without manual adjustment or control.

Advancements in intermodal technology have made it feasible to remove railway cars from the tracks for the purpose of loading, unloading, or transport by means other than by rail. Existing couplers and connectors are often very heavy and protrude from the ends of railway cars making it difficult for cranes and intermodal vehicles to lift the cars on and off the tracks. It is further desired to provide a coupler suitable for intermodal railway vehicles intended to be easily lifted on and off of the railway tracks.

SUMMARY OF THE INVENTION

The Automatic Intermodal Railcar Coupler of my invention comprises a male coupler to be attached in the rear of a railway car and a female coupler to be attached in the front of a second railway car so that when the cars are pushed together in contact with each other, they will be coupled together without damage to either car or their contents. The male coupler further comprises a horizontal shaft, which is hollow to accommodate fluid and electrical connectors, and a vertical shaft protruding underneath the horizontal shaft The female coupler further comprises a receptacle containing fluid and electrical connectors that can be joined with those in the horizontal shaft of the male coupler and a knuckle to catch and restrain the vertical shaft of the male coupler so that the cars will be pivotally connected together. The receptacle of the female coupler is held in place by a safety catch when air pressure is applied to release the car's brakes, thus preventing the cars from becoming uncoupled while in transport, yet this receptacle is attached to a shaft with enough vertical movement to allow the cars to be automatically uncoupled when air pressure is released by lifting the entire railway car containing the male coupler vertically off the tracks by means of an intermodal vehicle or other type of crane so that the vertical shaft of the male coupler rises above the knuckle of the female coupler. The receptacle is provided with a V shaped housing so that the horizontal shaft does not need to be perfectly aligned with the receptacle for successful coupling.

DETAILED DESCRIPTION

Figures 1, 2, 3, 4, 5, 6:
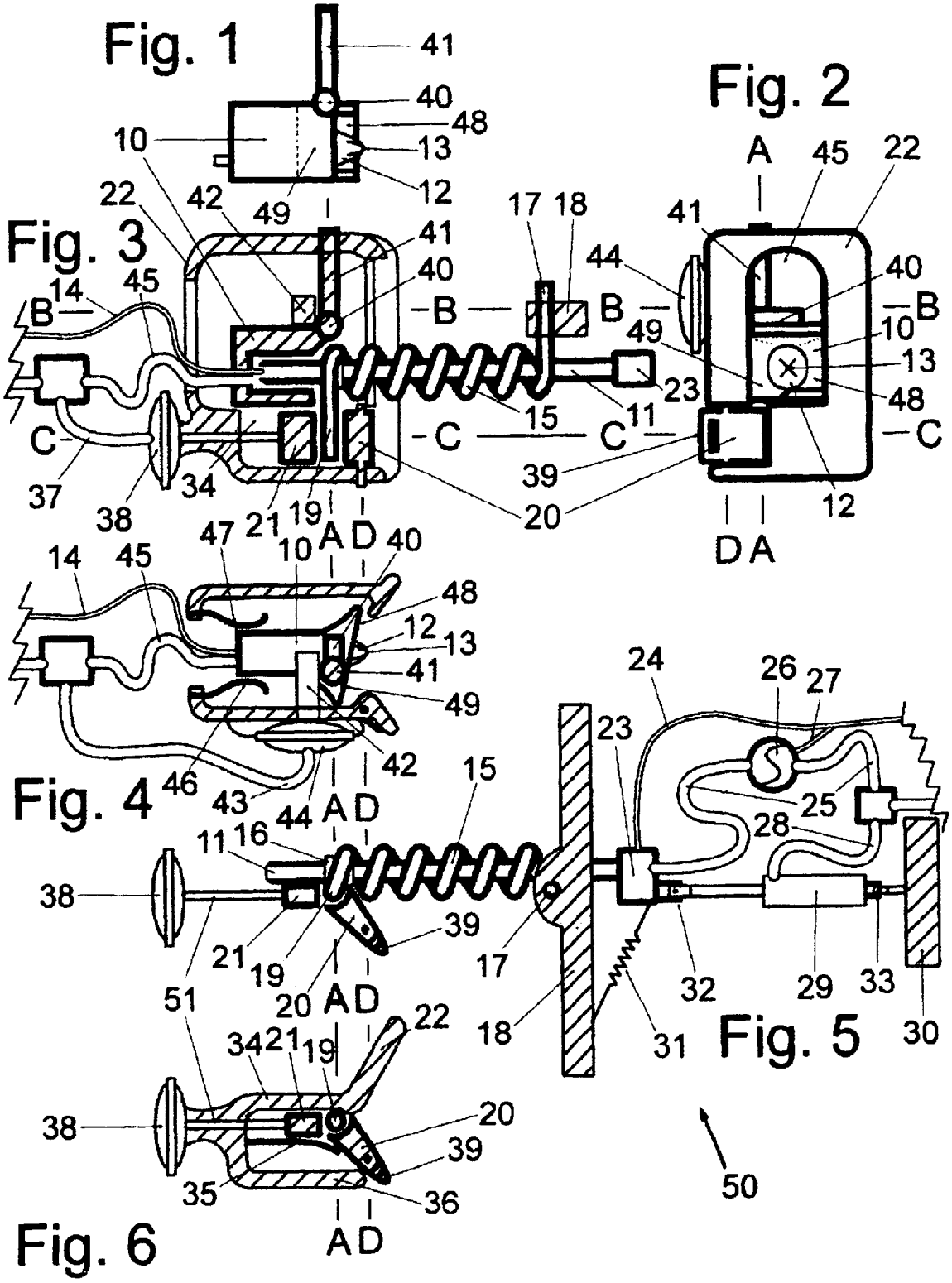
FIG. 1 is a side plan view of an electrical and fluid receptacle according to the present invention.
FIG. 2 is a front plan view of a female coupler according to the present invention.
FIG. 3 is a right side cutaway view of the female coupler in FIG. 2 at a vertical plane extending front and rear from axis A with a male coupler according to the present invention.
FIG. 4 is a top cutaway view of the female coupler in FIG. 2 at elevation B.
FIG. 5 is a top plan view of a male coupler together with a knuckle and an anvil according to the present invention.
FIG. 6 is a top cutaway view of the female coupler in FIG. 2 at elevation C.

I will now describe the preferred embodiment of my invention with reference to the accompanying drawings, wherein like numerals are used to refer to like parts.

FIG. 1 shows a side plan view of a fluid and electrical receptacle 10, which is mostly cylindrical and hollow to receive a horizontal shaft 11 partially within when a male coupler 50, as shown in FIG. 5 is connected with a female coupler 22 as shown in FIG. 3. The horizontal shaft 11 is hollow so it can contain a plurality of fluid and electrical connectors (not shown). The electrical connectors can be of the pin or spade types well known to those skilled in the electrical arts to be used for connecting electrical circuits of highway trailers to highway vehicles and should be attached both to an electrical connector 14 in the receptacle and a wiring harness 24 projecting from the horizontal shaft end plug 23. Though a pin type male electrical connector 14 is shown, one skilled in the electrical arts will recognize that a broad variety of connectors such as video and fiber optic connectors can also be used.

Due to the great variety of electrical connectors available to perform highly specialized tasks, such as connecting a plurality of computers installed in different railway cars together in a common data network, no preferred embodiment of electrical connectors is claimed in this invention, except to say that a broad variety of connectors can be accommodated. If only a single low voltage electrical connection is needed, then it is preferred that the horizontal shaft 11 be electrically isolated from the rest of the vehicle with an insulating coating so that it can engage the connector 14 directly, as shown in FIG. 3, without the need for additional connectors within.

To help guide the horizontal shaft 11 into proper position so that fluid and electrical connections can be made during a coupling operation, the receptacle 10 should have a conic or horn shaped orifice with asymmetrical wings 48, 49 which appear in the shape of a "V" when viewed from above, as shown in FIG. 4, so that the horizontal shaft 11 does not need to be perfectly aligned with the receptacle 10 for successful coupling. To protect electrical connectors from dirt and corrosion when not in use and also to provide an air tight seal when the horizontal shaft 11 is engaged, the receptacle 10 should be provided with a paraboloidally shaped flexible dust boot 12 which inverts when contacted by the horizontal shaft 11 during a coupling operation to be pushed inside the cylindrical portion of the receptacle 10 when coupling is complete. It is well known in the art that electrical connectors are often lubricated with electrically conductive grease which gathers dust and other contaminants, thus it is preferred that male electrical connectors such as plugs, spades, and pins, such as the connector 14, be installed inside the boot 12 of the receptacle 10 and any female connectors, such as jacks and socket (not shown), be installed inside the hollow horizontal shaft 11. The boot 12 is preferably made of fiber reinforced silicon rubber or a similar grease resistant plastic material with a plurality of slits 13 on its tip to allow the horizontal shaft 11 to pass through it during a coupling operation, yet return to normal position to provide a dust resistant seal when the male coupler 50 is not engaged.

It is well known to those knowledgeable in the art that the preferred working fluid for railway car brakes is compressed air, therefore in my preferred embodiment, a fluid connection completely fills the horizontal shaft 11, entirely surrounding any electrical connectors inside, thus eliminating the need for separate hoses and fluid connectors. Unless a fluid other than compressed air is used, the horizontal shaft 11 does not require a dust boot because the rapid discharge of compressed air resulting from the normal operation of railway car brakes is thought to be sufficient to prevent contamination of any electrical connector inside. While a spring operated cap (not shown) could be fitted to the end of the shaft 11 with a tab extending from the side to open the cap when contacting the dust boot 12 during a coupling operation, and other means of obtaining an air tight seal on the receptacle 10 could also be used, such as rubber "O" rings, the paraboloidal boot 12 is the preferred method of sealing the receptacle 10 because the discharge of compressed air from the horizontal shaft 11 when aligned with, but not connected to the receptacle 10, such as during an uncoupling operation, could result in containation of any electrical contacts inside if dust protection is not provided. The dust boot 12 also allows for a looser more flexible fit between the shaft 11 and the receptacle 10 to reduce the possibility of damage to electrical connectors during coupling. It will be understood that additional fluid connections, such as a hydraulic connection (not shown), could also be included inside the receptacle 10 and horizontal shaft 11 beside any electrical connectors.

FIG. 5 shows a top plan view of a male coupler 50. The horizontal shaft 11 is rigidly attached to a shock absorbing coil spring 15 by a flange 16. The horizontal shaft 11 prevents the shock absorbing spring 15 from bending out of alignment when cars contact each other during a coupling operation, thus preventing damage to the railway cars resulting from the force of impact. One end of the spring 15 further comprises a vertical shaft 17 which is pivotally attached to a vehicle frame 18. The other end of the spring 15 further comprises a second vertical shaft 19 which is restrained by a knuckle 20 and an anvil 21 when connected to the female coupler 22. The end plug 23 of the horizontal shaft 11 is shown fitted with an electrical wiring harness 24 which can connect to electrical connectors (not shown) inside the shaft 11, The end plug 23 is also fitted with a hose 25 which connects to a pressure valve 26. The pressure valve 26 prevents working fluid, such as compressed air, from escaping through the hose 25 when the brakes of the railway car (not shown) are released without a receptacle 10 being connected to the horizontal shaft 11, by automatically closing off fluid flow when an excessive difference between the fluid pressure and outside atmospheric pressure is detected. Such valves are well known in the art to prevent air from escaping from an air braking system when a railway car is the last car of a train. It will be understood that the electrical wire 27 between the pressure valve 26 and the wiring harness 24 gives the valve 26 additional facility to vent pressure for rapid application of the railway car's brakes (not shown) when voltage is applied to a solenoid switch inside the valve 26 by passing current through the wire 27 by remote control. This is a design improvement over radio controlled brake valves commonly used to vent pressure from the ends of trains because air can be vented from all of the cars of a train simultaneously with an anti-lock brake system (not shown) controlling brake pressure to prevent flat spotting of steel railway car wheels. It is well known in the railroad industry that venting brake pressure only from the locomotive and rear car of a train without the facility to control brake pressure on individual cars often leads to flat spotting. Those knowledgeable in the art will also understand that if compressed air is to be used as the preferred working fluid, it is also preferable that a small amount of air bypass the valve 26 to keep any electrical connectors inside the shaft 11 free of dust.

FIG. 5 also shows that a hose 28 supplies fluid to a pneumatic piston 29, pivotally connected between both the horizontal shaft end plug 23 and the vehicle frame 30, which applies tractive force to extend the horizontal shaft 11 perpendicularly to the vehicle frame 18 for the purpose of engaging the female coupler 22. Those knowledgeable in the art will understand that a hydraulic cylinder (not shown) can also be used in place of the piston 29. A retraction spring 31 pivots the horizontal shaft 11 and spring 15 underneath the vehicle frame 18 through at least ninety degrees of horizontal rotation around the vertical shaft 17 when fluid is not supplied to the pneumatic piston 29. The piston 29 may also incorporate oil and gas shock absorbing features well known to those knowledgeable in the art to increase the facility to dampen the occilations of the spring 15 after a coupling operation. Because the spring 15 allows a limited amount of vertical angular movement of the horizontal shaft 11 during uncoupling from the female coupler 22, the pivots 32 and 33 are preferably universal joints or ball joints. The piston 29 may also be fitted with an internal or external spring (not shown) to hold the vertical shaft 11 parallel with the vehicle frame 18 when retracted by the retraction spring 31. A cap (not shown) can be hung from the vehicle frame 18 to engage the end of the horizontal shaft 11 when it is in a retracted position to protect electrical connectors (not shown) inside the shaft from dust.

FIG. 6 shows a top cutaway view of the female coupler 22 in FIG. 2 at elevation C. The downward extending end of spring 15 that comprises a vertical shaft 19 is restrained by a knuckle 20 and an anvil 21 which may further comprise semi-cylindrical surfaces to completely surround the vertical shaft 19 on axis A. Alternatively, the housing of the female coupler 22 can further comprise a wall 34 to partially surround the vertical shaft 19 on axis A. The knuckle 20 is connected to the female coupler 22 by a vertical pivot on axis D and is held closed by a spring 35 that will allow the knuckle to fold flat against the housing during a coupling operation. It will be understood that although a leaf spring 35 is shown, other types of springs and flexible materials can also be used. The anvil 21 is slidably connected to the female coupler 22 so that it can be pushed back by the vertical shaft 19 during a coupling operation. When the vertical shaft 19 passes behind the folded knuckle 20, the spring 35 snaps the knuckle into its normal location as shown, restraining the vertical shaft 19. Fluid is supplied through the hose 37 to the piston chamber 38, which is rigidly attached to the female coupler 22 so as to actuate, by means of a connecting rod 51, linear movement of the anvil 21 to force the anvil 21 against the vertical shaft 19 which in turn is thrust against the knuckle 20 so that it is horizontally restrained in every direction on a plane perpendicular to axis A. Those knowledgeable in the art will understand that pneumatic piston chambers 38, 44 usually contain flexible diaphragms attached to internal pistons (not shown) to prevent the loss of air pressure, though hydraulic cylinders can also be used. A handle 39 is provided on the knuckle 20 for manual uncoupling. As long as no fluid pressure is supplied to the piston chamber 38, a trainman can push laterally on the handle 39 to bend the spring 35 and fold the knuckle 20 against the housing 36. If pressure is supplied through the hose 45 and the hose 37 to the chamber 38 with the knuckle 20 folded against the housing 36, the anvil 21 will push the vertical shaft 19 and the male coupler 50 completely out of the female coupler 22, simultaneously pulling the horizontal shaft 11, which is connected to the vertical shaft 19 by a flange 16, out of the receptacle 10, causing fluid pressure in hose 45 to be lost which those knowledgeable in the art will understand will automatically result in the railway car brakes (not shown) being set to prevent the car from rolling after being uncoupled. Alternatively, the handle 39 can be provided with a remote control (not shown) to accomplish this task without the need for a human operator.

FIG. 4 shows a top cutaway view of the female coupler 22 in FIG. 2 at elevation B. The receptacle 10 is connected to a horizontal shaft 40 which is pivotally connected to a vertical shaft 41 which is pivotally and slidably connected to the female coupler 22 along axis A to maintain the radial alignment of the receptacle 10 with the horizontal shaft 11 during the coupling operation. The receptacle rests on the wall 34 and is restrained from vertical movement by a safety catch 42. Fluid is supplied through the hose 43 to the piston chamber 44 to slide the safety catch 42 over the receptacle 10. The safety catch 42 can be provided with a bevel on the end (not shown) like a door latch to allow vertical movement of the receptacle 10 when fluid is not supplied to the chamber 44. Alternatively, a spring (not shown) can be installed inside the chamber 44 to retract the safety catch when fluid pressure in the chamber 44 is released to allow vertical movement of the receptacle 10. It will be understood that there are many ways for one knowledgeable in the art to install a safety catch, both pivotally and slidably to the female coupler 22, the receptacle 10, or its associated shafts 40 and 41 to restrain the vertical movement of the receptacle 10. An alternative embodiment (not shown) is for the receptacle 10 to be held in place solely by springs 46, 47 or a single large coil spring (not shown) during coupling and uncoupling operations, the shafts 40, 41 being omitted, with or without a safety catch built into the anvil 21, but such a system may not guarantee the proper radial alignment of a plurality of electrical connectors inside the horizontal shaft 11 and the receptacle 10. Regardless of the type of safety catch, when fluid pressure is reduced, vertical movement of the receptacle 10 is permitted along axis A and the male and female parts can automatically be uncoupled by lifting the male coupler 50, along with an attached railway car, in a vertical direction until the bottom of the vertical shaft 19 is above the top of the knuckle 20. A high arched opening 45 is provided in the front of the coupler 22 as shown in FIG. 2 to allow the horizontal shaft 11 to be pulled out of the receptacle 10 when the male coupler 50 is elevated in this manner. In the event that the horizontal shaft 11 is lifted higher than the arched opening 45 permits, the spring 15 allows some vertical angular movement and the receptacle 10 is provided with a horizontal shaft 40 to allow it to pivot in a vertical plane to accommodate this angular movement without damage to any electrical and fluid connects inside. The horizontal shaft 40 should be limited to less than thirty degrees of angular freedom to ensure that the receptacle 10 will return to a horizontal position on top of the wall 34 after an uncoupling operation is complete. A spring (not shown) can be provided around the vertical shaft 41 to forcibly return the receptacle to its original position if gravity alone is insufficient to accomplish this. The electrical connector 14 and hose 45, which supplies fluid to the hoses 37 and 43 as well as the rest of the railway vehicle (not shown), should incorporate a corkscrew type twist as shown in FIG. 3 and FIG. 4 to allow the receptacle 10 to pivot vertically and horizontally as well as move upward vertically. Centering springs 46 and 47 position the receptacle in proper alignment with the horizontal shaft 11 during the coupling operation. One knowledgeable in the art will understood that although leaf springs 46, 47 are shown, other types of springs or flexible material can also be used. Wings 48 and 49 in the front of the receptacle 10 center the horizontal shaft 11 into proper alignment during the coupling operation. It will be understood that one wing 48 protrudes farther forward than the other wing 49 to better accommodate the twists of the spring 15 and the vertical shaft 19.

One skilled in the art will recognize that other methods for providing controls may be selected without departing from the teachings of this invention. It is intended that railway cars and locomotives equipped with this invention should also be equipped with computer microprocessors and sensors multiplexed together to communicate along a common data link as part of any electrical connections described above so that railway train operators will have continuous control over the status of every component of a railway train and that cars can be selectively coupled and uncoupled by remote control.

Although I have now described my preferred embodiment of my invention, those skilled in the art will recognize that my invention may take other forms without departing from the spirit or teachings thereof. The foregoing description is intended, therefore, to be illustrative and not restrictive, and the scope of my invention is to be defined by the following claims.

I claim:

1. An assembly for connecting railway cars comprising a male part connected to a first railway car and a female part connected to a second railway car, said male and female parts capable of being combined into one assembly for the purpose of coupling said first and second railway cars together, said male part further comprising a vertical shaft connected to a horizontal shaft, said horizontal shaft protruding from said first railway car in the direction of said second railway car, said female part further comprising an anvil, slidably connected to said second railway car, capable of pushing against said vertical shaft of said male part, a knuckle, pivotally connected to said second railway car, together with said anvil, capable of surrounding and restraining said vertical shaft of said male part in a plane perpendicular to said vertical shaft, a receptacle, capable of surrounding and remaining said horizontal shaft of said male part in a plane perpendicular to said horizontal shaft, pivotally and slidably connected to said second railway car on the same vertical axis as said vertical shaft of said male part when said vertical shaft of said male part is surrounded and restrained by said anvil and said knuckle.

2. The assembly for connecting railway cars of claim 1 wherein the said horizontal shaft is hollow.

3. The assembly for connecting railway cars of claim 2 further comprising a fluid connection within said horizontal shaft and said receptacle.

4. The assembly for connecting railway cars of claim 1 further comprising an electrical connection within said receptacle.

5. The assembly for connecting railway cars of claim 1 wherein said receptacle further comprises a flexible seal between said receptacle and said horizontal shaft having the means of containing pressurized fluids within said horizontal shaft and said receptacle.

6. The assembly for connecting railway cars of claim 5 wherein said flexible seal further comprises a dust boot capable of preventing the passage of dust into said receptacle.

7. The assembly for connecting railway cars of claim 1 wherein said receptacle is further connected to said second railway car by at least one centering spring capable of aligning said receptacle on a common axis with said horizontal shaft such that said receptacle surrounds said horizontal shaft when said first railway car is moved into contact with said second railway car on a straight railway track.

8. The assembly for connecting railway cars of claim 1 wherein said receptacle further comprises a horn shaped orifice capable of guiding said horizontal shaft inside said receptacle when said first railway car is moved into contact with said second railway car on a curved railway track.

9. The assembly for connecting railway cars of claim 1 wherein said receptacle is further connected to said second railway car by at least one shaft capable of radially aligning said receptacle on the axis of said horizontal shaft such that a plurality of fluid or electrical connectors inside said horizontal shaft compatible with fluid or electrical connectors inside said receptacle can conduct fluid or electricity when said first railway car is moved into contact with said second railway car.

10. The assembly for connecting railway cars of claim 1 wherein said receptacle further comprises a safety catch capable of restraining the vertical movement of said receptacle such that said vertical shaft connected to said horizontal shaft is vertically restrained within said knuckle and said anvil when said horizontal shaft is restrained by said receptacle.

11. The assembly for connecting railway cars of claim 10 wherein said safety catch further comprises a piston chamber capable of restraining said safety catch when fluid is supplied to said chamber such that the vertical movement of said receptacle can be selectively restrained and unrestrained in response to said fluid.

12. The assembly for connecting railway cars of claim 1 wherein said horizontal shaft is connected to said first railway car by a shock absorbing spring capable of preventing damage to said first and second railway cars when they are moved into contact with each other.

13. The assembly for connecting railway cars of claim 1 wherein said horizontal shaft is connected to said first railway car by a pivot.

14. The assembly for connecting railway cars of claim 13 further comprising a retraction mechanism connected between said horizontal shaft and said first railcar capable of pivoting said horizontal shaft at least 90 degrees in a horizontal plane.

15. The assembly for connecting railway cars of claim 14 wherein said retraction mechanism further comprises a spring capable of pivoting said horizontal shaft of said male part such that said horizontal shaft is not extended from said first railway car in the direction of said second railway car.

16. The assembly for connecting railway cars of claim 14 wherein said retraction mechanism further comprises a piston capable of pivoting said horizontal shaft of said male part such that when fluid is supplied to said piston, said horizontal shaft is extended from said first railway car in the direction of said second railway car.

17. The assembly for connecting railway cars of claim 1 wherein said knuckle further comprises a spring connected to said female part that flexibly permits said knuckle to pivot when contacted by said vertical shaft of said male part when said first railway car is moved into contact with said second railway car and pushes said knuckle into a position surrounding said vertical shaft when not in contact with said vertical shaft.

18. The assembly for connecting railway cars of claim 1 wherein said knuckle further comprises a handle for manually pivoting said knuckle.

19. The assembly for connecting railway cars of claim 1 wherein said knuckle further comprises a remote control device for pivoting said knuckle.

20. The assembly for connecting railway cars of claim 1 wherein said anvil further comprises a piston chamber connected to said second railway car capable of sliding said anvil such that when fluid is supplied to said piston chamber, said anvil pushes said vertical shaft of said male part away from said female part until said horizontal shaft of said male part is not in contact with said receptacle of said female part.

21. The assembly for connecting railway cars of claim 20 wherein said anvil fixer comprises a safety catch for restraining the vertical movement of said vertical shaft when surrounded by said knuckle and said anvil.

* * * * *